United States Patent [19]

Krumbeck

[11] 4,283,803

[45] * Aug. 18, 1981

[54] PROCESS FOR IMMERSING IN A SWIMMING POOL DISABLED PERSONS USING A WHEELCHAIR

[75] Inventor: Keith Krumbeck, Milwaukee, Wis.

[73] Assignee: The Cheney Company, Inc., New Berlin, Wis.

[ * ] Notice: The portion of the term of this patent subsequent to Feb. 27, 1996, has been disclaimed.

[21] Appl. No.: 12,058

[22] Filed: Feb. 14, 1979

Related U.S. Application Data

[63] Continuation of Ser. No. 801,466, May 31, 1977, Pat. No. 4,141,089.

[51] Int. Cl.[3] ..... E04H 3/19; B66B 9/00

[52] U.S. Cl. ..... 4/496; 4/504; 4/254

[58] Field of Search ..... 4/172, 172.18, 172.19, 4/134, 145, 185 L, 251, 496, 504, 254; 5/63, 81 R; 128/365, 369; 187/1 R, 9 R; 297/DIG. 4, DIG. 10

[56] References Cited

U.S. PATENT DOCUMENTS

| | | | |
|---|---|---|---|
| 2,648,849 | 8/1953 | Webb et al. | 4/185 L |
| 4,141,089 | 2/1979 | Krumbeck | 4/185 L |

FOREIGN PATENT DOCUMENTS

| | | | |
|---|---|---|---|
| 116462 | 9/1929 | Austria | 4/185 L |

*Primary Examiner*—Frederick R. Schmidt
*Attorney, Agent, or Firm*—Morton C. Jacobs

[57] ABSTRACT

A swimming pool lift installation for the handicapped employs a platform for carrying a wheelchair that is lowered and elevated with the platform so that a handicapped person can sit on his chair and be lowered into the pool for swimming away from the chair and can leave the pool by swimming back into the wheelchair. The chair is releasably secured to the platform so that there is no danger of it being rendered unstable by its buoyancy in the water and so that it can be wheeled on and off the platform. A water hydraulic system operates the lift to avoid contamination of the pool.

3 Claims, 4 Drawing Figures

PROCESS FOR IMMERSING IN A SWIMMING POOL DISABLED PERSONS USING A WHEELCHAIR

BACKGROUND OF THE INVENTION

This is a continuation of U.S. patent application Ser. No. 801,466, filed May 31, 1977, which issued as U.S. Pat. No. 4,141,089 on Feb. 27, 1979.

This invention relates to a swimming pool lift that carries a handicapped person's wheelchair and lowers it into and elevates it out of a swimming pool.

It is well known that swimming is an extremely desirable form of physical therapy for handicapped persons. However, in the past the handicapped or invalids confined to wheelchairs have had great difficulty getting into and out of swimming pools. They have generally had to be lifted out of their wheelchairs by attendants and carried by these attendants into the water and then carried out of the water and back to the chair. Such procedures tend to limit the access of handicapped persons to swimming pools by the dependence on such attendants, their costs, and the associated indignities.

SUMMARY OF THE INVENTION

Accordingly, it is an object of this invention to provide a new and improved swimming pool lift for wheelchairs.

Another object of this invention is to provide a new and improved lift platform for swimming pools such that an attendant can lower a wheelchair into a swimming pool to allow a handicapped swimmer to unbuckle himself from the chair and swim away by pushing from the platform.

Another object of this invention is to provide a new and improved lift platform for swimming pools such than an attendant can return the wheelchair alone firmly retained thereon into a position out of the water to fold away until the swimmer wishes to leave the pool.

Another object of this invention is to provide a new and improved lift platform for swimming pools such that an attendant can relower the platform and wheelchair safely into the water so that the handicapped swimmer can swim onto it and buckle himself into the chair.

Another object of this invention is to provide a new and improved lift platform for swimming pools such that an attendant can elevate the platform and the handicapped person in the wheelchair on the platform safely back out of the swimming pool.

Another object of this invention is to provide a new and improved wheelchair lift platform for swimming pools utilizing a water hydraulic system.

Another object of this invention is to provide a new and improved wheelchair lift platform for swimming pools utilizing side rails for controlling a swimmer's buoyancy.

Another object of this invention is to provide a new and improved wheelchair lift platform for swimming pools providing a manual push-off into the pool.

Another object of this invention is to provide a new and improved folding platform utilizing locks for the wheels of a wheelchair so that the wheelchair will be retained on the platform when the swimmer is away from the platform.

In accordance with this invention, swimming pool apparatus for handicapped persons includes a wheelchair lift platform at the edge of the swimming pool so that a wheelchair can be readily wheeled onto and off of said platform respectively from and back to the deck of the swimming pool. The lift platform includes means for lowering said platform into the water of said pool with the seat of the wheelchair submerged and for elevating said platform therefrom, and means for releasably securing a wheelchair to said platform when lowering said wheelchair into said pool and raising said wheelchair therefrom.

Thereby a handicapped person can sit on a wheelchair secured to said platform while being submerged, can swim away from a submerged wheelchair, and can swim back to the submerged wheelchair to be elevated out of said swimming pool.

Features of this invention include the use of a water hydraulic system with separate controls for lowering and raising the lift platform and for varying the rates thereof and for folding the platform out of the way and latching it in the folded condition. Side rails and seat belts on the lift platform add to the swimmer's ability to maneuver in water and to his safety. A stop on the platform limits the travel of the wheelchair, and another stop limits the level of submergence of the platform in the swimming pool.

BRIEF DESCRIPTION OF THE DRAWING

The foregoing and other objects of this invention, the various features thereof as well as the invention itself, may be fully understood from the following description when read together with the accompanying drawing in which.

In the drawing, corresponding parts are referenced throughout by similar numerals.

DETAILED DESCRIPTION OF AN EMBODIMENT OF THE INVENTION

Figure 1:
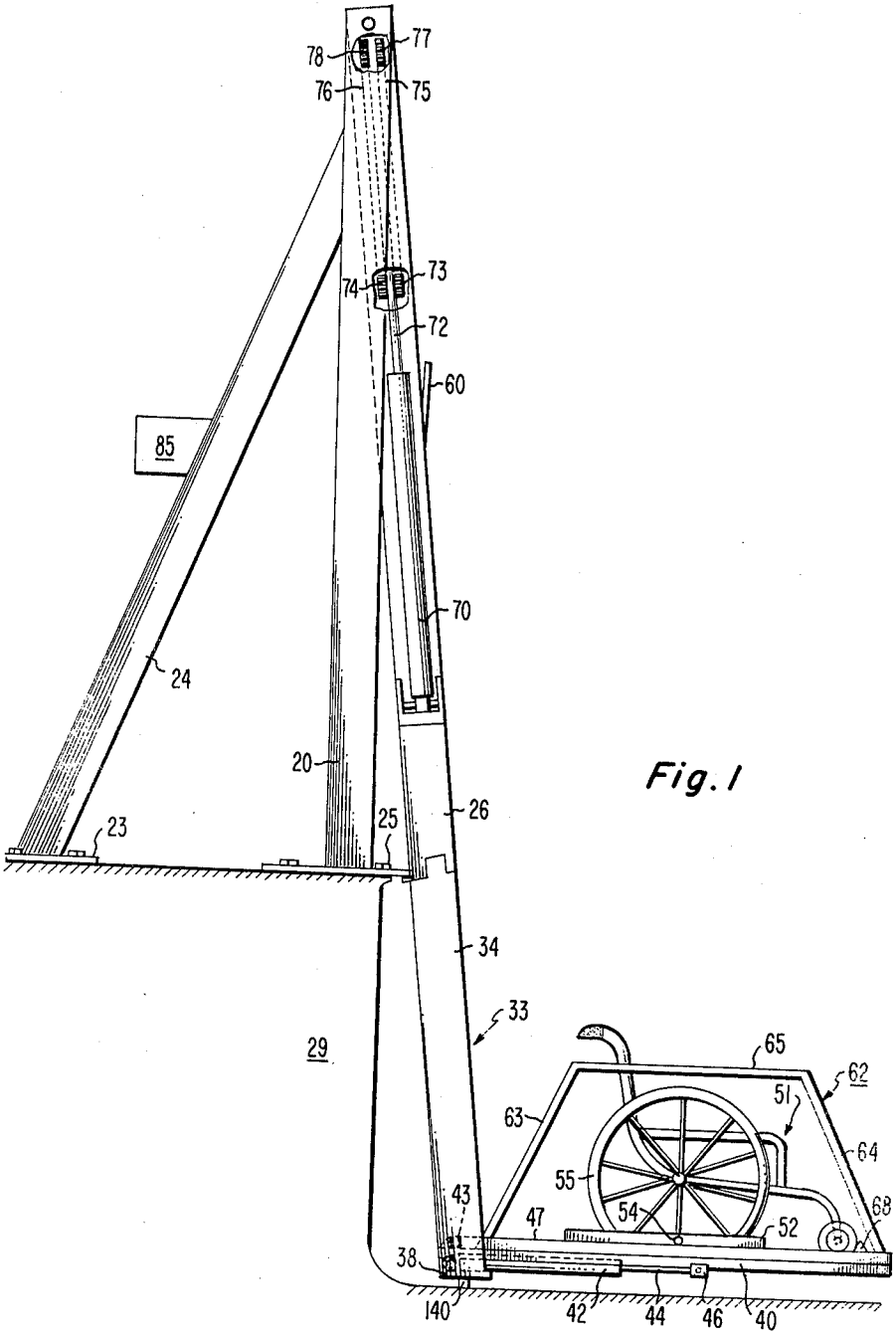
FIG. 1 is a side elevation view with parts cut away of a swimming pool lift embodying this invention and illustrating a wheelchair on the lift platform and submerged in a swimming pool.

The framework for the swimmer's lift consists of two forward vertical anchoring standards 20 and 22 and two rear support members 24 (omitted from FIG. 2); the members 24 are inclined and welded at the top to the vertical members 20 and 22. The base of these members is anchored by bolts to anchor plates 23 which are themselves bolted to the top deck of the swimming pool 29.

Bolted to the vertical frame-members 20 and 22 at their tops is a cross-member 30 in an additional framework that also consists of two vertical members 26 and 28 welded to the cross-member 30. All of these structural members are preferably stainless steel tubing or channeling; the vertical members in one suitable construction are one and one-half by three inch rectangular tubing, and the cross-member is a three-inch channel. The lower ends of vertical members 26 and 28 are respectively hooked to anchor plates 25 and 27 that are bolted to the deck of the swimming pool 29. An intermediate angle iron 32 is welded between the two vertical members 26 and 28 to stabilize those members and prevent their pitching and yawing during operation of the lift. Thus, standards 20, 22 and 24 provide a sturdy base anchored to the deck of the swimming pool. The stationary framework, formed by members 26 and 28 and cross-bars 30 and 32, is also firmly retained in position by being bolted to those base standards and by means of anchor plates 25 and 27, the latter are also bolted to the deck of the swimming pool at one end, and extend around the members 26 and 28 to retain them in position and prevent their twisting under the torques applied by the raising and lowering of the lift platform 40.

Figure 2:
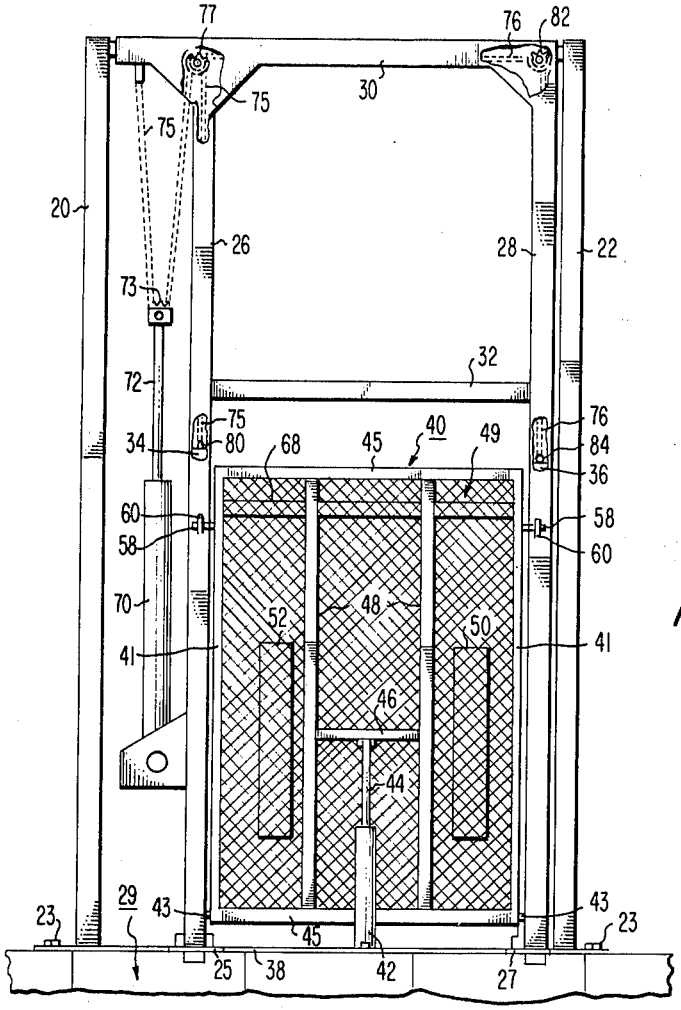
FIG. 2 is a front elevation view with parts cut away of the swimming pool lift of FIG. 1 and with the platform elevated in folded position.
Figure 3:
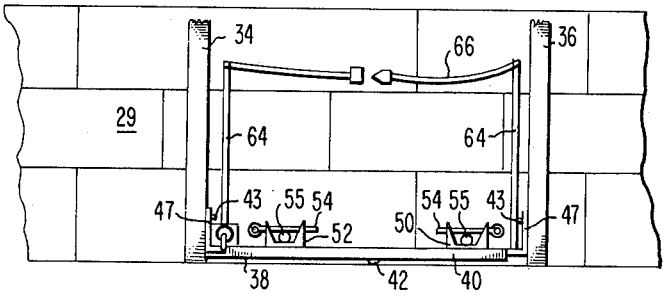
FIG. 3 is a front elevation view of the platform portion of the swimming pool lift of FIG. 1 and with the platform in lowered position in a swimming pool.
Figure 4:
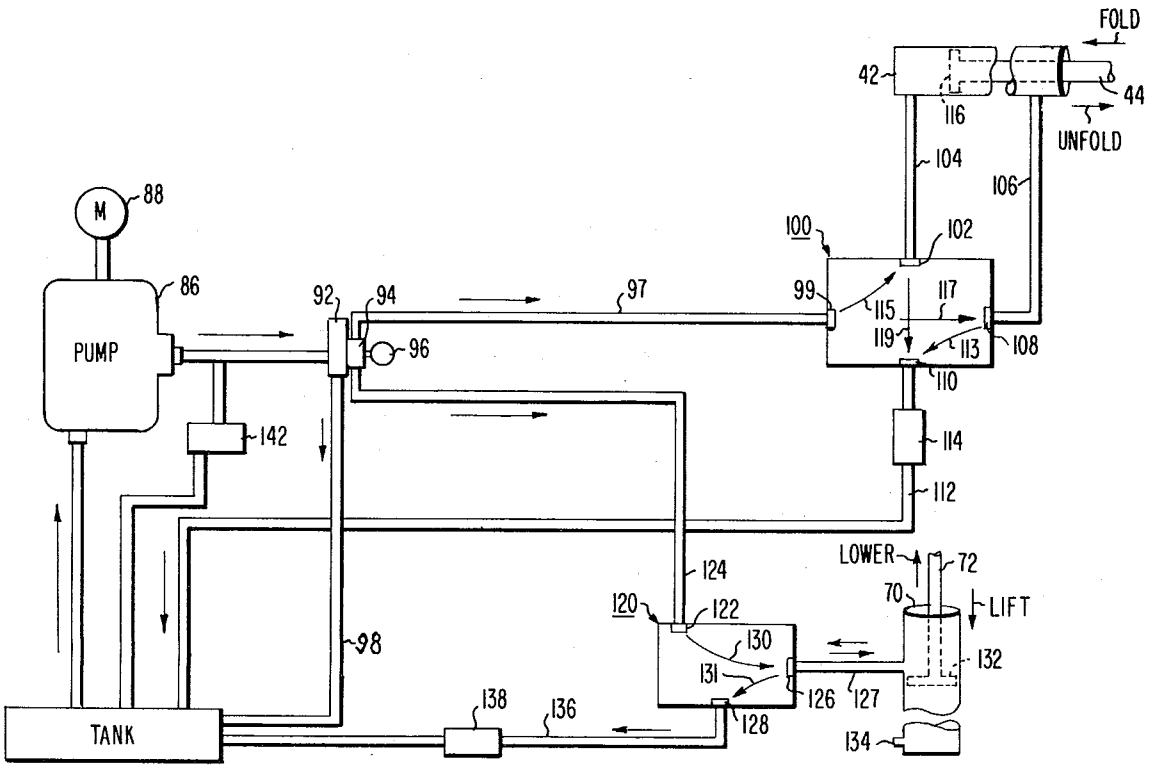
FIG. 4 is a schematic diagram of a hydraulic flow and control system for operating the swimming pool lift of FIG. 1.

A "U"-shaped slide 33 for supporting a platform 40 is formed by two sliding members 34 and 36 (FIG. 3) formed of rectangular tubing that slide within the hollow tubes 26 and 28, and a cross-plate 38 which is welded between the two slide members 34 and 36 to insure a unitary slide structure; cross-plate 38 also provides a rest and stop for the platform when it is pivoted down in the horizontal position. The platform 40 of the lift consists of a rectangular framework with side members 41, cross-members 45 and intermediate members 48 parallel to the sides, and a cross-member 46 between members 48. This platform 40 is hinged at its rear sides (through upstanding hinge plates 47 welded to sides 41) by pins 43 to slide members 34 and 36. A hydraulic cylinder 42 has its housing pivotally mounted on the the plate 38; this mounting may be in a central position as shown in FIG. 2 (or to one side, as may be desirable for ease of access to the cylinder for servicing purposes). The piston 44 of the cylinder 42 is pivotally mounted to the intermediate frame member 46 of the platform, and it acts in the extended position of the cylinder 42 to fold the platform 40 about its hinge pins 43 to the vertical position (FIG. 2) and, in the other piston position, to unfold the platform 40 to the horizontal operating position (FIGS. 1 and 3) of that platform. Extending between the platform's frame members 41, 43, 46, and 48 is an expanded-metal open-weave gridwork 49 which provides the basic platform surface for support of a wheelchair 51 carrying a handicapped person. Also mounted on the outer portions of the framework are two channel members 50 and 52 which extend about two feet and are offset from the inner end of the platform by about ten inches or so. These channel members have a pair of opposite holes in the legs thereof near the outer end through which a pin 54 slides in order to anchor the wheel 55 of the wheelchair 51. The use of an expanded metal grid 49 for the chair-supporting surface of the platform 40 permits the passage of water through the platform when it is moving either down or up through the water. This also reduces the required force to operate the platform in its different positions. Extending from either end of the platform are two fingers 58 which lock behind metal tabs or hooks 60 that are formed in (or struck out of) the vertical members 26 and 28. In the folded position these fingers engage behind the tabs or hooks 60 and insure that the platform is safely retained in the folded position.

The hinge side plates 41 also provide the anchoring for two rails 62, which have vertical members 63 and 64 (secured to the rear and forward ends of the side plates 41 by welding or the like) and horizontal cross arms 65. The horizontal side rails 62 provide side guards and lateral support for the user during operation of the lift. The rails 62 also have secured thereto seatbelts 66 (FIG. 3) which are bolded or otherwise secured to the angle iron forming the side rail 62 which can be belted across the lap of the user. The belts can be clamped across the chair itself, to maintain the chair in its anchored down position; this arrangement may be used as a supplement to the wheel pinning configuration 52, 54, or instead thereof. A front guard plate 68 (FIG. 1) extends across the platform 40 near the front edge thereof; it is in the form of an angle mounted to form a "V"-shaped safety stop for the front wheels of a wheelchair; other forms of stops may also be used.

The lifting and lowering of the platform is performed by means of a cylinder 70 whose housing is anchored to a bracket on the side of vertical frame member 26 and whose piston 72 bears at the upper end two rotating sprocket wheels 73 and 74. Two chains 75 and 76 are anchored to the end of cross-bar frame member 30 and pass, respectively, around the sprocket wheels 73 and 74 and back around two sprockets 77 and 78 at the upper corner of frame member 26 (see cutaway sections of FIGS. 1 and 2). The center line of sprocket 77 is at the edge of frame member 26 so that chain 75 can pass around that sprocket and down through the tubing 26 to be connected to a welded tab 80 at the top end of vertical slide 34. The other chain 76 passes from sprocket 78 to a sprocket wheel 82 at the upper corner of member 28; the wheel's center point is on the inner edge of frame member 28 so that the chain 76 passes down through the center of the tubing 28 and is anchored to a tab 84 at the top edge of slide 36.

The control of the cylinders 70 and 42, for operation of the platform 40 to a folded and unfolded position and to elevate it into and out of the pool 29, is by means of the water hydraulic control system 85 shown in FIG. 5. This control system may be secured to the standards 24 for ready access to an operator. A water pump 86 driven by a suitable motor 88 supplies the water power for operating the cylinders 42 and 70 and for the valves 100 and 120 controlling the direction of operation. The pump 86 may be the same pump commonly associated with filtration of the swimming pool; it is preferably so arranged in order to use existing equipment in the swimming pool and to have the motor 88 and the pump 86 remotely positioned from the lift itself. Alternatively, a tank 90 (such as a five-gallon water tank) may be used for a water reservoir in which to supply the driving fluid. Water from the tank 90 (or swimming pool 29) passes via the pump 86 to a pressure regulator 92 which has a suitable damper 94 and guage 96; the return flow path from the regulator is via hose 98 back to the reservoir 90. These parts may also be mounted on the base standards 20, 22 and 24; however, preferably all electrical parts such as the motor 88 are mounted in remote locations.

The pump 86 may be a piston pump which would tend to produce substantial oscillations in the output of the regulator; damper 94 insures that these oscillations are not apparent in the reading of the pressure guage 96. This damper also insures that all of the driving liquid is likewise generally smooth in its pressure application. A first outlet 97 from the damper 94 connects to the input port 99 of a four-way valve 100, which has a pressure port 102 connected by a hose 104 which is, in turn, connected to the base end of the platform-pivoting cylinder 42. From the piston end of that cylinder 42 a hose connection 106 is made to a second pressure port 108, which in turn is internally connected to the return port 110; return port 110 has a return hose connection 112 to the reservoir 90. A flow control valve 114, which can be adjusted to limit the rate of flow of the return fluid, is inserted in the return line 112.

In operation with the valve 100 actuated to the position shown by the arrows 113 and 115, the pressurized water flows into input 99, thence to pressure port 102 to the base side of the cylinder 42 and back via line 106, pressure port 108 return port 110 and return hose 112. In this instance, the piston 116 is driven to extend the rod 44 and unfold the platform to the position shown in FIGS. 1 and 3. When the valve 100 is actuated to be connected as shown by arrows 117 and 119, the internal connection is as follows. From the input 99 through pressure port 108, then via line 106 to the rod end of the piston 116, and back via hose 104, pressure port 102 and return port 110 to the return line 112. In this operating condition the pressure is on the rod side of the piston 116 to return the rod 44 within the cylinder housing and fold the platform 40 back into the folded condition shown in FIG. 2.

A second valve 120 has its input port 122 connected to another line 124 from the damper 94. Internally, as indicated schematically by arrow 130, for one operating condition of the valve 120, the input port 122 is connected to supply pressurized water to the pressure port 126 and via line 127 to the rod side of the piston 132 of lift cylinder 70. A vent opening 134 at the end of the cylinder housing 70 permits the escape of pressurized air as the piston 132 drives down into the housing. In the opposite position of the valve 120 the pressure line 126 is connected to the return port 128 (as shown by arrow 131); and port 128, via line 136 and an adjustable flow control 138 in that line, is connected back to the reservoir 90. In this position of the valve, the weight of the platform and chair and occupant on the platform 40 (via slides 34 and 36 and sprocket wheels and chain connections acting upwards on the top of rod 72), is sufficient to force the piston 132 in the upward direction. The connection between input port 122 and pressure port 126 is closed, so that the return liquid is forced by this gravitational action of the platform to return from the rod side of the piston 132 through line 127, through the valve (arrow 131) to return port 128, and back to the tank 90; and control 138 in line 136 determines the rate of flow of the liquid back and thereby the rate of lowering of the platform 40 into the swimming pool. During this operation, air returns via vent 134 to fill the vacuum caused by the movement of the piston 132 within cylinder 70.

In overall operation, the platform is normally in folded position as shown in FIG. 2, with the fingers 58 locked behind the tabs 60. In that position, the platform is safely retained out of the way of the swimming pool and people swimming therein; also there is no danger of people leaning against the platform and its falling, should there be any loss of pressure in the lines due to leakage or otherwise.

To release the platform 40 from the locking tabs 60, the operator attendant actuates valve 120 to the condition represented by the internal flow path 130; the water flows to press down on piston 132, which lifts the platform to be free of the tabs 60, at which point the valve 120 is then actuated back to a neutral position. Thereupon, the valve 100 is actuated to the condition represented by the arrows 113 and 115 to drive the piston and piston rod 44 to unfold the platform from the folded position shown in FIG. 2 to the unfolded position shown in FIG. 1. When fully unfolded the platform is resting on cross-plate 38 and the valve 100 is returned to a neutral position. After the platform is unfolded the person in the wheelchair can roll his chair onto the platform and into the channel members 50 and 52, so that the attendant can lock the large chair wheels 55 in those channel members. The swimmer can, alone or with the assistance of an attendant, set up the seatbelt 66 over his lap or both over his lap and the arms of his chair.

Thereupon, the attendant actuates the valve 120 to the position represented by arrow 131, and the force of gravity operating on the platform lowers it with the liquid in the housing on the rod side of the piston 132 returning via path 131, port 128 and return flow 136, with the rate of lowering being controlled by the flow control valve 138. The attendant continues to lower the platform 40 to the desired position which may be partially immersed in the water or fully immersed touching or nearly touching the bottom of the swimming pool (as shown in FIG. 1). A stop 140 (FIG. 1) is preferably attached to the underside of cross-plate 38; it can be of a desired suitable dimension so as to position the platform a certain distance above the floor of the pool, and thereby the wheelchair seat is submerged to a desired level in the water as is the swimmer. The latter then unbelts the seatbelt 66 and is in a position to swim off from the chair. In one embodiment, it was found suitable to provide a vertical lift travel of about 46 inches to lower the lift platform about 38–40 inches below the water surface which was about 4–8 inches below the pool deck.

During the lowering operation, the swimmer can hold onto the side rails 62 to steady himself and the wheelchair if his comfort so requires. In swimming off the user grasps the platform's side rails 62 and is enabled to provide the desired push to swim away clear of his wheelchair and the platform. The platform may be lifted from the pool, while the user is engaged in swimming, by actuating the valve 120 from the neutral position back to the position shown by the internal connection 130. The pressurized liquid is effectively applied to the piston 132 to drive the rod 72 and thereby lift the platform. The cross-member 38 serves as a stop for the platform in the elevated condition when it hits the bottom of frame members 26 and 28. At this time the attendant can remove the latch pins 54 from chair wheels 55 and wheel off the chair. Thereupon, another swimmer can wheel on the lift platform and be submerged in the manner described above. If the lift is temporarily not in use, the attendant can fold up the platform if it is not desired to have it overhanging the swimming pool, this operation is performed by actuating the valve 100 to the position represented by internal connection arrows 117 and 119. The hydraulic flow then is effective on the rod side of the piston 116 to retract rod 44 and fold up the platform 40 about its hinge.

At this time, the attendant also can latch the platform in the folded position by then actuating the valve 120 to the position of arrow 131, in which case the platform lowers the short distance necessary to latch the fingers 58 behind the tabs 60.

When the swimmer has completed his swimming, the operation described above can be repeated to unlatch the platform, lower it into the swimming pool, permit the swimmer to swim back onto the chair, grasping the rails 62 and rebuckle himself under the seatbelts. Thereupon, the valve 120 is actuated to lift the chair, the swimmer unbuckles himself, the wheel pins 54 are removed and the swimmer wheels back off of the platform. Then the next swimmer can wheel on to the lift platform and use it in the manner described above, or the platform can be folded up and latched as described above.

A bypass valve 142 may be provided between the output of the pump 86 and the reservoir 90 if a motor separate from the filtration pump is employed. This bypass valve is opened up to permit bypassing of the regulator 92 and the control connections when starting the motor, so that it is not heavily loaded in that condition. Thereafter, the bypass valve is closed and the system is then operated as described above.

With the use of a water hydraulic system, there is no danger of contamination of the pool. Moreover, all bearings are nylon which avoids the presence of any contaminating oil. Moreover, wheelchairs are also built with nylon bearings, so that they can be submerged in the pool water after passing through a shower. A suitable hydraulic drive uses a pump that operates at about 500 psi to supply water at about 3 gallons per minute, with the regulator operating at 300 psi.

The anchor plates 23, 25 and 27 are preferably easily removable so that the lift can be removed from the swimming pool when not needed, and the plates can be reanchored when the lift is reinstalled.

Various other modifications will be apparent to those skilled in the art from the foregoing description, and such modifications will come within the scope of this invention as set forth in the following claims.

Accordingly, new and improved swimming pool apparatus is provided by this invention which enables expanded swimming pool use by handicapped persons using wheelchairs.

What is claimed is:

1. A process of immersing disabled persons who use a wheel chair into a swimming pool for swimming therein, said process comprising:

wheeling a wheel chair with a disabled person thereon onto a chair lift;

attaching the chair securely to the lift so that the chair remains secure and stable against buoyancy effects when immersed in the pool and the disabled person swims away from the chair;

lowering the lift and attached chair with disabled person into the pool and enabling the person to swim away from the attached chair while the unoccupied chair remains attached to the lift in a secure and stable condition so that the unoccupied chair can be elevated or the person can swim back to the immersed chair and reseat himself thereon;

elevating the chair lift with the unoccupied attached chair while the person is swimming in the pool, lowering the chair lift and unoccupied attached chair in order to enable the swimmer to return to the chair, and, thereupon, elevating the chair and swimmer from the pool;

whereby disabled persons can be immersed in a swimming pool within their individual capabilities to swim away from and return to the secured wheel chairs without the assistance of an attendant.

2. The process of claim 1, and further comprising:

after elevating the lift with an unoccupied chair, detaching and wheeling off the unoccupied chair, and repeating the process for immersing a plurality of disabled persons on wheel chairs for swimming in the pool, including for each disabled person the steps of wheeling a wheel chair with a disabled person onto the lift, attaching the chair securely to the lift against buoyancy effects, and lowering the lift and attached chair into the pool so that the person can swim away from the attached chair.

3. A process of immersing disabled persons who use a wheel chair into a swimming pool for swimming therein, said process comprising:

wheeling a wheel chair with a disabled person thereon onto a chair lift;

attaching the chair securely to the lift so that the chair remains secure and stable against buoyancy effects when immersed in the pool and the disabled person swims away from the chair;

lowering the lift and attached chair with the disabled person into the pool and enabling the person to swim away from the attached chair while the unoccupied chair remains attached to the lift in a secure and stable condition so that the unoccupied chair can be elevated or the person can swim back to the immersed chair and reseat himself thereon;

and upon the swimmer's return to the chair on the lift, elevating the chair lift with the disabled person and chair from the pool, detaching the chair from the lift, and wheeling the chair and disabled person off the lift;

whereby disabled persons can be immersed in a swimming pool within their individual capabilities to swim away from and return to the secured wheel chairs without the assistance of an attendant.

* * * * *